United States Patent [19]

Ferrigno, Jr.

[11] 4,068,296

[45] Jan. 10, 1978

[54] CONTROL FOR REMOTE CONTROL WIRING SYSTEM

[75] Inventor: William L. Ferrigno, Jr., Peacedale, R.I.

[73] Assignee: General Electric Company, New York, N.Y.

[21] Appl. No.: 701,063

[22] Filed: June 30, 1976

[51] Int. Cl.[2] ..... H01H 47/32

[52] U.S. Cl. ..... 361/190; 361/205

[58] Field of Search ..... 317/148.5 B, 149, 155.5, 317/157, 131; 361/143, 152, 154, 189, 190, 201, 205, 210, 168

[56] References Cited

U.S. PATENT DOCUMENTS

| | | | |
|---|---|---|---|
| 2,981,869 | 4/1961 | Balint | 317/137 |
| 3,869,651 | 3/1975 | Long et al. | 317/148.5 B |
| 3,920,906 | 11/1975 | Gargini | 317/148.5 B |

OTHER PUBLICATIONS

*Low Voltage Control* Square D Publication 8/48 p. 10 relied upon.

*Primary Examiner*—Gerald Goldberg

*Attorney, Agent, or Firm*—Paul E. Rochford; Walter C. Bernkopf

[57] ABSTRACT

A remote control wiring system is provided which includes a transformer for providing power to a low voltage subsystem which, through relays, controls the opening and closing of higher voltage load circuits of the remote control wiring system. A plurality of relays are provided, one for controlling each of the load circuits. A first circuit includes in series a first solid state switching device, such as a suitable transistor, SCR or triac, and a relay, or a plurality of relays connected in parallel. Similarly, a second circuit includes in series a second solid state switching device, such as a suitable transistor, SCR or triac, and the relay, or the plurality of relays connected in parallel. A two-position switch is incorporated in the low voltage subsystem in association with the first and second circuits. In one position of the switch the first circuit is closed through the first solid state switching device to energize the aforementioned relay or relays for closing the load circuit or circuits associated therewith. In a second position of the switch the second circuit is closed through the second solid state switching device to energize the relay or relays for opening the load circuit or circuits.

5 Claims, 1 Drawing Figure

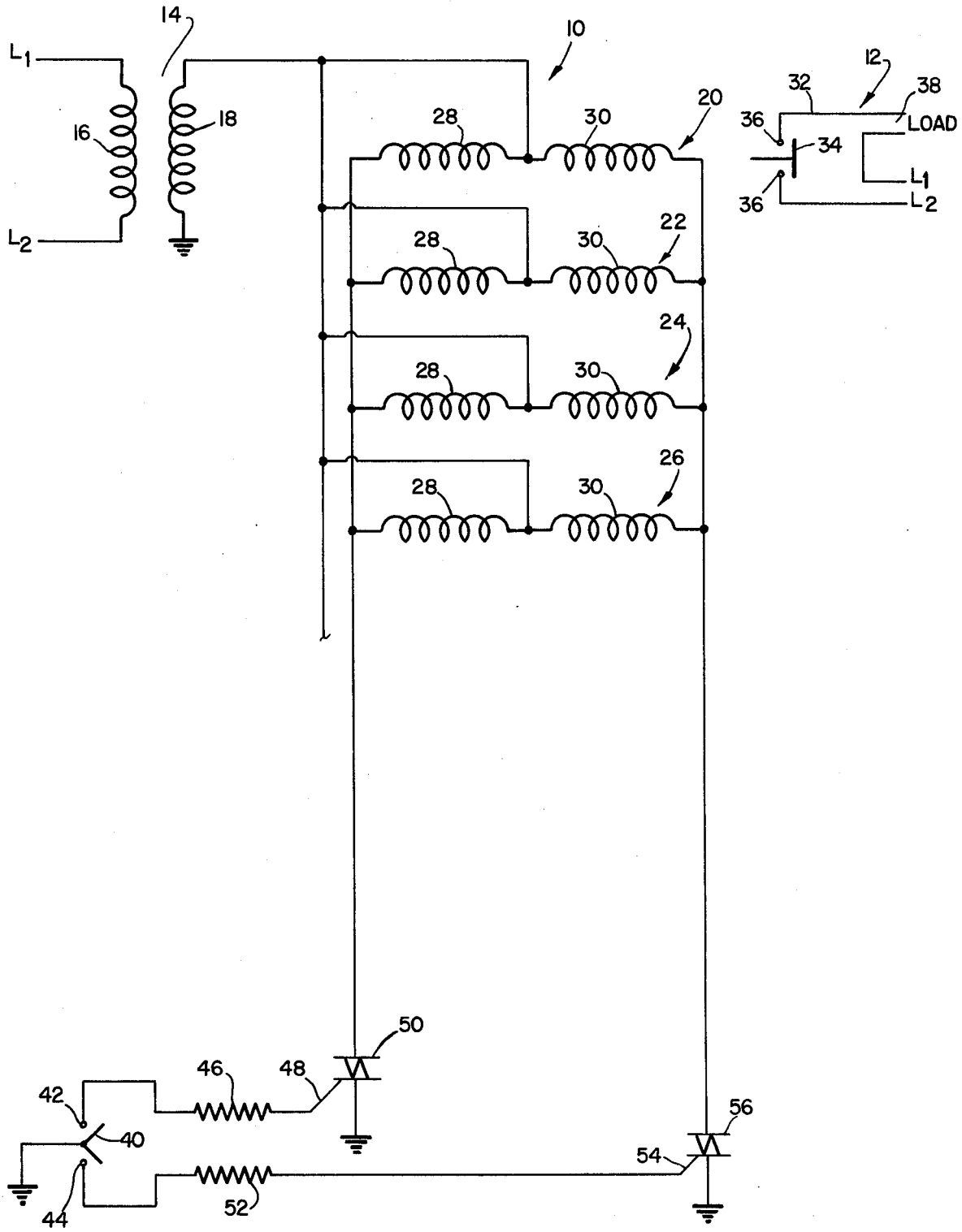
14
10
L1
L2
16
18
12
32
38
36
LOAD
34
L1
36
L2
20
28
30
22
24
26
50
46
48
42
40
44
52
54
56

CONTROL FOR REMOTE CONTROL WIRING SYSTEM

BACKGROUND OF THE INVENTION

1. Field of the Invention

This invention relates to remote control wiring systems in which high voltage load circuits are controlled by relays which are disposed in a low voltage subsystem and are controlled by switches in the subsystem.

2. Description of the Prior Art

Remote control wiring systems are designed to provide substantial flexibility; for example, a plurality of separate load circuits may be simultaneously controlled from a single switch. Alternatively, the system may provide for the control of a single load circuit from a plurality of locations. The switches in each case are normally connected to energize relays in a low voltage subsystem which permits the employing of relatively small gauge wire. Because of the distance between the relays and the switches this small gauge wire may be of substantial length.

A conventional relay employed in such a system normally draws approximately 0.5 ampere. The remote control switches employed for controlling the relays are normally rated at three amperes. Therefore, such a switch can normally control some six relays connected in parallel. One problem that arises in connection with such systems in that the transmission of even three amperes over the length and gauge of wire employed in such remote control wiring systems can cause a substantial voltage drop. This drop may be of such magnitude that the relays controlled the switch may not operate properly. Thus, in installing such a system it is necessary to use care as to the length and gauge of wire employed and under some circumstances it may be necessary to limit the versatility of the installation in order to limit the length of wire or alternatively to employ somewhat heavier gauge wire with resultant increase in cost.

In some cases in order to utilize the full advantages of a remote control wiring system, it may be desirable to control, for example, all of the lights and other appliances on the entire floor of a building from a single switch located near the entrance. In such case, the number of relays to be actuated from the single switch may exceed the six referred to above and may even include all 24 relays which fit into a normal relay box or panel. Such a use raises two problems. If the switch is used to control 24 relays, for example, it can be appreciated that the switch would have to handle a total of 12 amperes which would exceed the current capacity of switches normally employed in such installations. Secondly, even if a switch of adequate size to handle this current were employed, the voltage drop caused by a current of this magnitude would be of such magnitude that the relays would not operate properly or the length of wire which could be employed would have to be severely limited or the gauge of the wire would have to be increased, thereby reducing the versatility and economy of such remote control wiring systems.

By the present invention, these limitations of prior art remote control wiring systems are avoided and a control arrangement is provided which permits the utilization and simultaneous opening or simultaneous closing of a substantial number of load circuits without exceeding the capacity of the switches and without introducing an undesirably high voltage drop despite the use of a substantial length of control wire of relatively small gauge.

Accordingly, it is an object of this invention to provide a remote control wiring system which provides for the effective control from a single switch of a greater number of load circuits than has heretofore been possible.

It is another object of this invention to provide a remote control wiring system which permits the use of small gauge wire despite the substantial length required and which permits the control of the relays without any risk of a voltage drop in the wiring system of magnitude sufficient to interfere with the proper operation of the relays.

SUMMARY OF THE INVENTION

In carrying out the invention, in one form thereof, a remote control wiring system is provided which includes a transformer for providing power to a low voltage subsystem which, through relays, controls the opening and closing of higher voltage load circuits of the remote control wiring system. A plurality of relays are provided, one for controlling each of the load circuits. A first circuit includes in series a solid state switching device, such as a suitable transistor, SCR or triac and a relay, or a plurality of relays connected in parallel. Similarly, a second circuit includes in series a second solid state switching device, such as a suitable transistor, SCR or triac and the relay, or the plurality of relays connected in parallel. A two-position switch is incorporated in the low voltage subsystem in association with the first and second circuits. In one position of the switch the first circuit is closed through the first solid state switching device to energize the aforementioned relay or relays for closing the load circuit or circuits associated therewith. In a second position of the switch the second circuit is closed through the second solid state switching device to energize the relay or relays for opening the load circuit or circuits.

DESCRIPTION OF THE DRAWING

For a better understanding of the invention, reference is made to the accompanying drawing, the single FIGURE of which shows a wiring diagram of one embodiment of this invention.

DESCRIPTION OF THE PREFERRED EMBODIMENT

Referring now to the drawing, the invention, in one form thereof, includes a low voltage subsystem 10 for controlling a higher voltage subsystem 12 which includes a plurality of load circuits, one of which is shown in the drawing. For providing low voltage, which may be in the order of 25 volts, to the low voltage subsystem 10, a transformer 14 is employed. The transformer includes a primary winding 16 and a secondary winding 18. The primary winding is connected; through lines $L_1$ and $L_2$ to the normal higher voltage power supply, usually in the order of 120 volts, available through the usual utility power lines.

The secondary 18 of the transformer is connected to each of a plurality of relays 20, 22, 24 and 26. It will be understood that while, for convenience and clarity of illustration, only four such relays have been illustrated in the drawing, a substantially greater number of such relays, and load circuits controlled thereby, will normally be incorporated in a remote control wiring system. The conventional number of such relays, arranged in a relay box, is 24. Each relay is of the two-coil solenoid type, with a first coil 28 being employed to close the relay contacts and a second coil 30 being employed to open the relay contacts.

Each relay is arranged to control one of the load circuits 32 of the higher voltage subsystem 12. For convenience only a single such load circuit 32 has been shown in the drawing, but it will be understood that a similar load circuit will be associated with each of the relays employed in the low voltage subsystem. As illustrated for relay 20, each relay includes a movable element 34 which is positioned to be moved into and out of engagement with contacts 36 for closing and opening the associated load circuit 32. Thus, when the element 34 engages the contacts 36, a circuit is completed from power lines $L_1$, $L_2$ through the relay contacts 36 and a load connected at 38.

In the present remote control wiring systems, a two-position switch is normally employed for directly energizing a relay or relays to control the load circuits associated therewith. Thus, for example, such a switch is connected in a suitable manner to directly energize the coil 28 of relay 20 for moving the relay element 34 to the closed position and is moved to a second position for energizing the coil 30 of the relay 20 to move the relay element 34 to the open position. This conventional arrangement has, however, caused two problems to arise. The two-position switches normally employed carry satisfactorily a maximum current of approximately 3 amperes. The relays utilized in such systems normally require approximately 0.5 ampere for actuation. One of the features of a remote control wiring system is the ability to control a plurality of load circuits from a single switch at one location. It will be apparent, however, that with the current limitations referred to above, a single switch can satisfactorily control only six load circuits simultaneously. In many cases, particularly where an entire floor of a building is to be controlled from a single switch usually positioned near the entrance to the suite, it is desirable for this switch to control substantially more than six load circuits. In fact, it may be desirable to control from a single switch all 24 of the relays normally positioned in a relay box. It will be apparent that were this arrangement to be attempted with present equipment, the switch would be required to handle 12 amperes. This would necessitate the substitution of substantially heavier duty switches for those presently employed with the result of substantially increased cost.

Even if this were done a second problem would still remain. In order to provide the desired versatility of controlling load circuits over a wide area from a single location, or alternatively for controlling a single load circuit from a plurality of different locations, it is necessary to have a substantial length of wire between the switches and the relays controlled thereby. Normally, for economy reasons, it is desirable to utilize in the low voltage subsystem a relatively small gauge wire for connecting the switches to the relays which control the load circuits. Where even a current in the order of three amperes, in accordance with the present current limitations of the type of switches normally employed, flows in the system the voltage drop over the length of small gauge wire involved may be substantial. Unless care is taken in designing the installation and perhaps severe limitations imposed on the length of wire employed, this voltage drop could be sufficient to prevent the proper operation of the relays connected in the system. Alternatively, if it were felt necessary to provide a very substantial length of wire to achieve the desired flexibility and versatility of the system it might then be necessary to employ a heavier gauge wire and thus significantly increase the cost of the installation.

In accordance with the present invention, these limitations and costs of prior art systems are avoided by incorporating solid state switching devices in a particular manner in the system between the switches and the relays. In the particular embodiment shown, each solid state switching device comprises a triac, which is particularly suitable for utilization in this system, but it will be apparent that any type of solid state switching device, such as, for example, a suitable transistor or SCR, which is capable of providing control of the relays and still properly operating with a relatively small current in the lines between the controlling switch and the switching device may be employed.

Referring now to the specific embodiment shown, a two-position control switch 40 is included in the low voltage subsystem. While only a single such switch is shown in the drawing in order to more clearly illustrate and describe the invention, it will be understood that any desired number of such switches will be employed in a complete installation. The switch 40 is arranged to be movable to a first position in which it engages a first contact 42 and to a second position in which it engages a second contact 44. This engagement, in the switches normally employed in such systems, is only momentary. The contact 42 is connected through a resistor 46 to the gate 48 of a first triac 50. Similarly, the contact 44 is connected through a resistor 52 to the gate 54 of a second triac 56. In one particular embodiment of this invention, the resistors 46 and 52 are approximately 1,000 ohms and the triacs are of approximately 10 amperes capacity.

The triac 50 in the embodiment shown in the drawing is connected in a first circuit which includes in series the secondary winding 18 of the transformer 14 and the first coil 28 of each of the relays 20, 22, 24 and 26, the coils 28 of these relays being connected in parallel. While only four such relays have been illustrated, it will be understood, from the earlier discussion, that any desired number of such relays, with coils connected in parallel, may be employed in the low voltage subsystem. Similarly, the triac 56 is connected in a second circuit which includes in series the secondary 18 of the transformer and the second coil 30 of each of the relays 20, 22, 24 and 26, the coils 30 of these relays also being connected in parallel.

Energization of the first coils 28 through the triac 50 moves the associated relay elements 34 into engagement with contacts 36 to close the associated load circuits. Conversely, energization of the second coils 30 through the triac 56 moves the associated relay element 34 out of engagement with contacts 36 to open the associated load circuits.

In operation of this remote control wiring system, when it is desired, for example, to close the load circuits associated with the relays 20, 22, 24 and 26 shown in the drawing, the switch 40 is moved to momentarily engage contact 42. This provides a voltage to the gate 48 of the triac 50 causing that triac to be placed in a conducting state. This completes a circuit from the secondary 18 of the transformer 14 through the first coils 28 of the relays in parallel and through the triac 50. This causes movement of the relay elements 34 associated with these relays to a position engaging contacts 36 and completing a circuit through the load 38 of each of the associated load circuits.

Similarly, when it is desired to open the load circuits associated with the relays, 20, 22, 24 and 26, the switch 40 is moved to a position momentarily engaging contact 46, thereby completing a circuit through resistor 52 to apply a gating voltage to the gate 54 of the triac 56. This completes a circuit from the secondary 18 through the second coils 30 of these relays in parallel and through the triac 56. This causes the relay elements of these relays to be moved to the open position shown in the drawing, thereby opening the load circuits associated therewith.

While for purposes of illustration only four relays have been shown in the drawing, it will be understood from the foregoing discussion that any desired number of such relays may be included in parallel and controlled from a single switch 40. There is essentially no limit on the number of relays which may be employed and simultaneously actuated so long as there is sufficient power from the transformer and the triacs employed have sufficient current carrying capacity. Where, for example, 24 such relays are employed and the current required to actuate each relay is approximately 0.5 ampere, it can be seen that the current flowing through triac 50 and through the triac 56 will be in the order of 12 amperes. However, the current required to be handled by the switch 40 in momentarily closing the circuit either to the gate 48 or the gate 54 is significantly less, being only the amount necessary to provide the gating voltage to the triacs. In the example given, this current would be in the order of 25 milliamperes.

While a particular embodiment of the invention has been shown and described, it is not intended that the invention be limited to the particular construction so shown and described, and it is intended by the appended claims to cover all modifications which come within the spirit and scope of the appended claims.

I claim:

1. In a remote control wiring system which includes a low voltage wiring subsystem incorporating a plurality of relays for controlling higher voltage load circuits, the improvement wherein said low voltage subsystem includes:

a. a first circuit including one of said relays and a first solid state switching device in series therewith;

b. a second circuit including said one of said relays and a second solid state switching device in series therewith; and c. a switch movable to a first position for causing said first solid state switching device to be placed in a conducting state to energize said one of said relays to close the load circuit controlled by said one of said relays and movable to a second position for causing said second solid state switching device to be placed in a conducting state to energize said one of said relays to open said load circuit.

2. The remote control wiring system of claim 1, wherein:

a. said first solid state switching device is a triac including a gate and said second solid state switching device is a triac including a gate;

b. said switch includes a first contact connected to said gate of said first triac and a second contact connected to said gate of said second triac; and c. said switch in its first position engages said first contact to gate said first triac and in its second position engages said second contact to gate said second triac.

3. The remote control wiring system of claim 1, wherein:

a. said first circuit includes a plurality of said relays connected in parallel;

b. said second circuit includes said plurality of relays connected in parallel; and c. said switch in its first position causes said first solid state switching device to be placed in a conducting state to simultaneously energize said plurality of relays for simultaneously closing a plurality of load circuits controlled by said relays and in its second position causes said second solid state switching device to be placed in a conducting state to simultaneously energize said plurality of relays for simultaneously opening said plurality of load circuits.

4. The remote control wiring system of claim 3, wherein:

a. said first solid state switching device is a triac including a gate and said second solid state switching device is a triac including a gate;

b. said switch includes a first contact connected to said gate of said first triac and a second contact connected to said gate of said second triac; and c. said switch in its first position engages said first contact to gate said first triac and in its second position engages said second contact to gate said second triac.

5. The remote control wiring system of claim 3, wherein:

a. said plurality of relays in parallel have a total current requirement of a pedetermined amount for simultaneous actuation thereof; and b. said switch has a maximum current capacity which is less than said predetermined amount.

* * * * *